US011376647B2

(12) United States Patent
Klinkhammer et al.

(10) Patent No.: US 11,376,647 B2
(45) Date of Patent: Jul. 5, 2022

(54) TOOLS, MACHINES, AND METHODS FOR MACHINING PLANAR WORKPIECES

(71) Applicant: TRUMPF Werkzeugmaschinen GmbH + Co. KG, Ditzingen (DE)

(72) Inventors: Marc Klinkhammer, Ditzingen (DE); Dennis Traenklein, Nufringen (DE); Markus Wilhelm, Gerlingen (DE); Rainer Hank, Eberdingen/Hochdorf (DE); Leonard Schindewolf, Rutesheim (DE); Simon Ockenfuss, Boeblingen (DE); Jens Kappes, Leinfelden-Echterdingen (DE); Alexander Tatarczyk, Hoeffingen (DE); Joerg Neupert, Stuttgart (DE); Dominik Bitto, Muenchingen (DE); Markus Maatz, Leinfelden-Echterdingen (DE); Christian Jakisch, Boeblingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 16/363,516

(22) Filed: Mar. 25, 2019

(65) Prior Publication Data

US 2019/0217367 A1 Jul. 18, 2019

Related U.S. Application Data

(63) Continuation of application No. PCT/EP2017/074298, filed on Sep. 26, 2017.

(30) Foreign Application Priority Data

Sep. 26, 2016 (DE) ..... 102016118175.7
Oct. 12, 2016 (DE) ..... 102016119464.6

(51) Int. Cl.
*B21D 28/12* (2006.01)
*B21D 28/34* (2006.01)
*B26F 1/44* (2006.01)

(52) U.S. Cl.
CPC ..... *B21D 28/125* (2013.01); *B21D 28/34* (2013.01); *B26F 2001/4427* (2013.01); *Y10T 83/8732* (2015.04); *Y10T 83/8733* (2015.04)

(58) Field of Classification Search
CPC ..... B21D 28/12; B21D 28/125; B21D 28/14; B21D 28/34; B21D 28/246;
(Continued)

(56) References Cited

U.S. PATENT DOCUMENTS 4,242,898 A 1/1981 Salvagnini
4,412,469 A * 11/1983 Hirata ..... B21D 28/12 83/552
(Continued)

FOREIGN PATENT DOCUMENTS

CN 202 984 412 6/2013
DE 9307907 U1 7/1993
(Continued)

OTHER PUBLICATIONS

International Preliminary Report on Patentability in International Application No. PCT/EP2017/074298, dated Mar. 26, 2019, 8 pages (English translation).
(Continued)

*Primary Examiner* — Laura M Lee
(74) *Attorney, Agent, or Firm* — Fish & Richardson P.C.

(57) ABSTRACT

Tools for machining planar workpieces are provided that include an upper tool, an upper main body, and at least one tool body on the upper main body having a cutting edge. The tools further include a lower tool having a lower main body with a rest surface for the workpiece and a positioning axis
(Continued)

oriented perpendicular to the rest surface, at least one counter tool body on the lower main body that has a counter cutting edge that is a closed contour. The cutting edge of the at least one tool body has a cutting contour that corresponds to the closed contour of the at least one counter tool body, and at least one group of at least two counter tool bodies on the lower tool can be associated with the closed contour of the least one tool body.

10 Claims, 6 Drawing Sheets

(58) Field of Classification Search
CPC ..... B26F 2001/4427; Y10T 83/8727; Y10T 83/8732; Y10T 83/8733
USPC ..... 83/552, 553
See application file for complete search history.

(56) References Cited

U.S. PATENT DOCUMENTS

| | | | | |
|---|---|---|---|---|
| 4,520,646 | A | 6/1985 | Pauzin | |
| 4,951,375 | A * | 8/1990 | Erlenmaier | B21D 37/145 483/14 |
| 5,259,100 | A | 11/1993 | Takahashi | |
| 5,367,770 | A | 11/1994 | McCaughey | |
| 5,787,775 | A | 8/1998 | Stevens et al. | |
| 5,842,369 | A | 12/1998 | Kutschker | |
| 6,058,756 | A | 5/2000 | Kutschker | |
| 6,109,090 | A * | 8/2000 | Perazzolo | B21D 28/04 72/442 |
| 6,112,568 | A | 9/2000 | Lindstrom | |
| 6,655,250 | B1 * | 12/2003 | Ishii | B21D 28/12 83/410.9 |
| 6,715,329 | B1 | 4/2004 | Hametner | |
| 7,659,490 | B2 | 2/2010 | Belike | |
| 8,001,823 | B2 | 8/2011 | Straka et al. | |
| 8,042,369 | B2 | 10/2011 | Bytow et al. | |
| 8,087,278 | B2 | 1/2012 | Deis et al. | |
| 8,201,435 | B2 * | 6/2012 | Erlenmaier | B21D 28/125 72/442 |
| 8,375,763 | B2 | 2/2013 | Bauer | |
| 8,511,128 | B2 * | 8/2013 | Boepple | B23K 26/38 72/328 |
| 8,627,753 | B2 * | 1/2014 | Laib | B21D 28/36 83/553 |
| 2002/0072456 | A1 * | 6/2002 | Ichikawa | B21D 28/12 483/1 |
| 2006/0162413 | A1 | 7/2006 | Bauer et al. | |
| 2007/0105488 | A1 | 5/2007 | Bytow et al. | |
| 2009/0211326 | A1 * | 8/2009 | Laib | B21D 28/24 72/332 |
| 2010/0101297 | A1 | 4/2010 | Bauer et al. | |
| 2014/0090443 | A1 * | 4/2014 | Schmauder | B21D 28/20 72/452.9 |
| 2014/0283576 | A1 | 9/2014 | Jin et al. | |
| 2016/0107847 | A1 | 4/2016 | Grunewald | |
| 2019/0217360 | A1 | 7/2019 | Kappes et al. | |
| 2019/0217362 | A1 | 7/2019 | Klinkhammer et al. | |

FOREIGN PATENT DOCUMENTS

| | | | |
|---|---|---|---|
| DE | 20018936 | U1 | 1/2001 |
| DE | 69616689 | T2 | 8/2002 |
| DE | 10223637 | A1 | 12/2003 |
| DE | 102005003558 | | 7/2006 |
| DE | 10 2006 049 044 | | 4/2008 |
| DE | 10 2009 013437 | | 10/2009 |
| DE | 102013000864 | | 3/2014 |
| EP | 0757926 | | 2/1997 |
| EP | 1688195 | | 8/2006 |
| EP | 2527058 | B1 | 7/2014 |
| EP | 3 106 241 | | 12/2016 |
| JP | S54137469 | A | 10/1979 |
| JP | 2005131655 | A | 5/2005 |
| JP | 2007-534498 | | 11/2007 |
| WO | WO 2014206817 | | 12/2014 |

OTHER PUBLICATIONS

International Search Report and Written Opinion in International Application No. PCT/EP2017/074298, dated Jan. 9, 2018, 16 pages (with English translation).
PCT International Search Report and Written Opinion in International Application No. PCT/EP2017/074306, dated Jan. 31, 2018, 18 pages (with English translation).
PCT International Search Report and Written Opinion in International Application No. PCT/EP2017/074286, dated Jan. 9, 2018, 13 pages (with English translation).
U.S. Office Action in U.S. Appl. No. 16/364,398, dated Oct. 13, 2020, 16 pages.
U.S. Office Action in U.S. Appl. No. 16/363,486, dated Jul. 12, 2021, 25 pages.

* cited by examiner

TOOLS, MACHINES, AND METHODS FOR MACHINING PLANAR WORKPIECES

CROSS REFERENCE TO RELATED APPLICATIONS

This application is a continuation of and claims priority under 35 U.S.C. § 120 from PCT Application No. PCT/EP2017/074298 filed on Sep. 26, 2017, which claims priority from German Application No. 10 2016 118 175.7, filed on Sep. 26, 2016, and German Application No. 10 2016 119 464.6, filed on Oct. 12, 2016. The entire contents of each of these priority applications are incorporated herein by reference.

TECHNICAL FIELD

The invention relates to a tools and methods for machining planar workpieces.

BACKGROUND

A machine tool for machining planar workpieces is known from EP 3 106 241 A1. This machine tool comprises an upper tool that is moveable along a stroke axis by an upper stroke drive device in the direction of a workpiece to be machined by the upper tool and in the opposite direction, and which is moveable by a motor drive assembly along an upper positioning axis running perpendicular to the stroke axis. Associated with the upper tool is a lower tool that is moveable along a lower positioning axis by a motor drive. The upper tool and lower tool are each moveable independently of one another along their respective positioning axes in a frame interior of a machine frame. Associated with this machine frame are two workpiece rests for receiving the workpiece, to position the workpiece between the upper tool and the lower tool for machining.

A machine tool is further known from EP 2 527 058 B1. That document discloses a machine tool in the form of a press for machining workpieces, wherein an upper tool is provided on a stroke device that is moveable relative to a workpiece to be machined, along a stroke axis in the direction of the workpiece and in the opposite direction. A lower tool is provided in the stroke axis and opposite the upper tool and is positioned relative to a lower side. A stroke drive device for a stroke movement of the upper tool is controlled by a wedge gear. The stroke drive device with the upper tool arranged thereon is moveable along a positioning axis by a motor drive. The lower tool is thereby moved synchronously with the upper tool by a motor drive.

DE 10 2006 049 044 A1 discloses a tool for machining planar workpieces that can be used, for example, in a machine tool according to EP 2 527 058 B1. This tool for cutting and/or shaping planar workpieces includes a punch and a die. For machining a workpiece arranged between the punch and the die, the punch and the die are moved towards one another in a stroke direction. A cutting tool having a cutting edge is arranged on the punch, and at least two counter cutting edges are provided on the die. The punch and the die are rotatable relative to one another about a common positioning axis. The counter cutting edges are thereby so oriented relative to the common positioning axis that the cutting edge of the cutting tool can be positioned relative to the counter cutting edges by a rotary movement of the cutting tool of the punch. The distance of the counter cutting edges from the positioning axis corresponds to the distance of the cutting edge from the common positioning axis.

SUMMARY

This disclosure provides tools, machines, and methods for machining planar workpieces, by which the number of set-up operations during the machining of different material thicknesses of workpieces is reduced.

A tool for machining planar workpieces which has an upper tool that includes a clamping shaft and a main body, which lie in a common positioning axis, and includes at least one tool body arranged on the main body opposite the clamping shaft and having a cutting edge, and has a lower tool that includes a main body having a rest surface for the workpiece and has at least one counter tool body, provided on the main body that includes a counter cutting edge, wherein the main body of the lower tool has a positioning axis which is oriented perpendicular to the rest surface, wherein the upper and lower tools, for machining a workpiece arranged between them, are moveable towards one another in a stroke direction. In this tool, the counter cutting edge of the counter tool body is configured as a closed contour, and the cutting edge of the at least one tool body has on the upper tool a cutting contour which corresponds in profile to the closed contour of the counter cutting edge. There is provided on the lower tool at least one group of at least two counter tool bodies which correspond to the at least one tool body on the upper tool, wherein in the at least one group of counter tool bodies the size of the contour of the first counter tool body corresponds to the cutting contour of the tool body with a first cutting gap width and the size of the contour of the second or further counter tool body corresponds to the cutting contour of the tool body on the upper tool with a second or further cutting gap width. By such a tool it is made possible that different material thicknesses of the workpiece can be machined using the same tool. By the association of at least two counter tool bodies with a contour, which, relative to the cutting contour of the at least one tool body on the upper tool, include different cutting gap widths, it is possible using the same tool body on the upper tool to process at least two different material thicknesses of workpieces with one tool. For this purpose, it is provided that the at least one tool body with respect to the chosen closed contour to the corresponding counter tool body from the associated group on the lower tool takes place solely by a traversing movement perpendicular or inclined to the positioning axis of the upper tool and/or lower tool or by a combination of the traversing movement perpendicular or inclined to the positioning axis and by a rotary movement about the positioning axis of the upper tool and/or lower tool. Such a tool makes it possible to reduce the number of set-up operations and to adjust the tools to the material thicknesses of the workpieces to be machined.

In some embodiments, the counter tool bodies of the at least one first group of counter tool bodies on the lower tool are arranged in a line one behind the other. It is thereby possible to orient the tool body on the upper tool relative to the counter tool body, for example, by a traversing movement of the upper tool along the upper positioning axis of the processing machine. Alternatively, the counter tool body can be oriented relative to the tool body by a traversing movement of the lower tool along the lower positioning axis of the processing machine. A relative movement of the upper and lower tool can likewise be carried out.

An advantageous form of the tool provides that the at least one group of counter tool bodies can be inserted in the main body of the tool on a main body insert in each case individually or together on a main body insert. This has the advantage that, in the case of wear of the counter tool bodies, it is possible simply to change them without having to replace the entire lower tool.

It can further advantageously be provided that the at least one main body insert is rotatably arranged in the main body of the lower tool. For example, it can also be rotatably controlled in its orientation. An additional orientation of the closed contour of the counter tool body in the lower tool can thereby be made possible. The upper tool itself can likewise be arranged in a tool receptacle of the processing machine so that it is rotatable about its positioning axis, so that the tool body of the upper tool can be adjusted in terms of its orientation to the counter tool body of the lower tool.

In some embodiments, the upper tool is in the form of a multi tool and has at least two tool bodies, and the lower tool includes at least two groups of counter tool bodies. The at least two tool bodies arranged on the upper tool differ from one another in contour and/or size. This has the advantage that the versatility in the machining of workpieces is increased. For example, with the two different tool bodies on the upper tool, it is already possible to process two different closed contours. With one or more counter tool bodies that are correspondingly associated with the first or further tool body, a number of different material thicknesses of the workpieces can be machined in dependence on the number of associated counter tool bodies.

The at least two counter tool bodies of the at least one group lie outside a common circle in the rest surface of the lower tool. Any desired arrangement of the counter tool bodies is possible. Where there is a plurality of counter tool bodies the counter tool bodies individually associated with one another are arranged adjacent to one another per group. Alternatively, the plurality of counter tool bodies in the case of a plurality of groups can be so arranged and oriented that maximum utilization in terms of the number of counter tool bodies to be provided in the rest surface of the lower tool is achieved. The counter tool bodies can thereby be associated as a group, or an arbitrary unsorted arrangement can be chosen. The number of set-up operations can thus be reduced still further.

A further alternative embodiment of the tool provides that at least two counter tool bodies of the at least one group lie on a common circle in the rest surface of the lower tool and the contours of those counter tool bodies differ from a circular geometry and lie outside an angular position on the circle that is assumed by the contour on rotation along a circle. This makes it possible to achieve a further optimization in the introduction of the number of counter tool bodies in the rest surface of the upper tool.

Furthermore, the first and the at least one further group of counter tool bodies lie outside a common circle in the rest surface of the lower tool. An optimization in terms of the remaining support surfaces which adjoin the counter cutting edges of the counter tool bodies, and the number of counter tool bodies to be introduced is thereby at the forefront.

A processing machine has an upper tool that is moveable along a stroke axis by a stroke drive device in the direction of a workpiece to be machined by the upper tool and in the opposite direction and which can be positioned along an upper positioning axis running perpendicular to the stroke axis and is moveable along the upper positioning axis by a drive assembly. The processing machine further has a lower tool that is oriented relative to the upper tool and is moveable along a lower stroke axis by a stroke drive device in the direction of the upper tool and can be positioned along a lower positioning axis that is oriented perpendicular to the stroke axis of the upper tool, and is moveable along the lower positioning axis by a drive assembly. The motor drive assemblies are controllable by a controller of the processing machine to move the upper and lower tool. It is thereby provided that the traversing movement of the upper tool along the upper positioning axis and the traversing movement of the lower tool along the lower positioning axis are each controllable independently of one another so that, when a tool according to one of the above-described embodiments is used, it is possible to orient the tool body of the upper tool relative to at least one group of at least two counter tool bodies on the lower tool. By this independent control of the upper tool and/or lower tool, the at least one upper tool and the associated counter tool body can be chosen and positioned relative to one another in dependence on the material thickness of the tool to be machined. Adjustment of the cutting gap for the workpiece to be machined is thus achieved.

Via the processing machine the upper tool and/or lower tool carry out a traversing movement along their positioning axis or inclined to their positioning axis or can be positioned by a combination of one of the above-mentioned traversing movements with a superposition by a rotary movement about the positioning axis. Any desired orientation of the at least one tool body on the upper tool relative to the at least one counter tool body on the lower tool can thereby be made possible.

Also described are methods for machining planar workpieces, such as metal sheets, in which an upper tool that is moveable along a stroke axis by a stroke drive device in the direction of a workpiece to be machined by the upper tool and in the opposite direction and which can be positioned along an upper positioning axis running perpendicular to the stroke axis, is moved along the upper positioning axis by a drive assembly, and in which a lower tool that is oriented relative to the upper tool and can be positioned along a lower positioning axis which is oriented perpendicular to the stroke axis of the upper tool, is moved along the lower positioning axis by a drive assembly, and in which the motor drive assemblies are controlled by a controller to move the upper and lower tool, wherein a tool according to one of the preceding embodiments is used and the at least one tool body of the upper tool for machining the workpiece is chosen and, in dependence on the material thickness of the workpiece to be machined, there is chosen from the at least one group of counter tool bodies of the lower tool the counter tool body that forms with the tool body of the upper tool the cutting gap width required for the material thickness of the workpiece. Only a traversing movement of the upper and/or lower tool perpendicular to their positioning axes or along the upper and lower positioning axis is thereby controlled. Alternatively, a combination of the traversing movement perpendicular to the positioning axis and a rotary movement about the positioning axis of the upper and/or lower tool can be provided. Furthermore, it can alternatively be provided that a traversing movement of the upper and/or lower tool is controlled in which the traversing movement is inclined to the positioning axis of the upper and/or lower tool. This can also be superposed with a rotary movement of about the positioning axis. Accordingly, at least two workpieces having different material thicknesses can be machined using one tool, without the need for a change of tool. This reduces the set-up time and increases productivity.

The tool body and counter tool body are oriented relative to one another by a traversing movement along the upper and/or lower positioning axis and/or by a rotary movement of the upper tool and/or lower tool about the positioning axis. The flexibility in the traversing movement and/or the rotary movement of the upper tool and also in the traversing movement and/or the rotary movement of the lower tool makes possible a respective choice and association of the tool body and counter tool body for the required adjustment to the necessary cutting gap. Tolerances in the positioning axes can also be compensated for by such a tool.

Furthermore, a multi tool is used as the upper tool and, by controlling the processing machine, an activating device is actuated, by which one of the at least two tool bodies provided on the main body of the upper tool is chosen. By such a multi tool, the number in terms of the size and/or contour of the recesses to be introduced into the tool can be increased.

Other features and advantages of the invention will be apparent from the following detailed description, the drawings, and from the claims.

DESCRIPTION OF DRAWINGS

The invention and further advantageous embodiments and developments thereof will be described and explained in greater detail hereinafter with reference to the examples shown in the drawings. The features inferred from the description and the drawings can be applied in accordance with the invention individually or in any combination.

DETAILED DESCRIPTION

Figure 1:
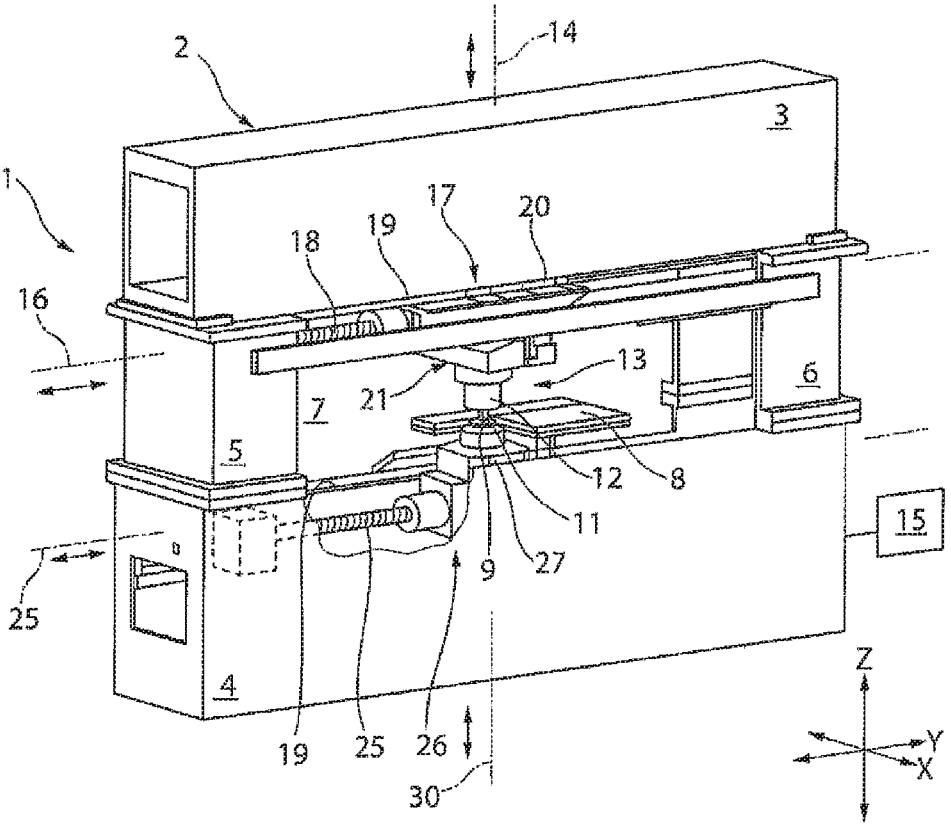
FIG. 1 shows a perspective view of a processing machine.

FIG. 1 shows a processing machine 1 that is configured as a punch press. This processing machine 1 includes a supporting structure with a closed machine frame 2 that includes two horizontal frame limbs 3, 4 and two vertical frame limbs 5 and 6. The machine frame 2 surrounds a frame interior 7 that forms the working area of the processing machine 1 with an upper tool 11 and a lower tool 9.

The processing machine 1 is used to machine planar workpieces 10 that for the sake of simplicity have not been shown in FIG. 1 and can be arranged in the frame interior 7 for machining purposes. A workpiece 10 to be machined is placed on a workpiece support 8 provided in the frame interior 7. The lower tool 9, for example in the form of a die, is mounted in a recess in the workpiece support 8 on the lower horizontal frame limb 4 of the machine frame 2. This die can have a die opening. In the case of a punching operation the upper tool 11 is a punch that dips into the die opening of the lower tool 9 formed as a die.

The upper tool 11 and lower tool 9, instead of being a punch and a die for punching, can also be a bending punch and a bending die for shaping workpieces 10.

The upper tool 11 is fixed in a tool receptacle on a lower end of a ram 12. The ram 12 is part of a stroke drive device 13, by which the upper tool 11 can be moved in a stroke direction along a stroke axis 14. The stroke axis 14 runs in the direction of the Z axis of the coordinate system of a numerical controller 15 of the processing machine 1 indicated in FIG. 1. The stroke drive device 13 can be moved perpendicular to the stroke axis 14 along a positioning axis 16 in the direction of the double-headed arrow. The positioning axis 16 runs in the direction of the Y axis of the coordinate system of the numerical controller 15. The stroke drive device 13 receiving the upper tool 11 is moved along the positioning axis 16 by a motor drive 17.

The movement of the ram 12 along the stroke axis 14 and the positioning of the stroke drive device 13 along the positioning axis 16 are achieved by a motor drive 17 that can be configured in the form of a drive assembly 17, e.g., a spindle drive assembly, with a drive spindle 18 running in the direction of the positioning axis 16 and fixedly connected to the machine frame 2. The stroke drive device 13, in the event of movements along the positioning axis 16, is guided on three guide rails 19 of the upper frame limb 3, of which two guide rails 19 can be seen in FIG. 1. The other guide rail 19 runs parallel to the visible guide rail 19 and is distanced therefrom in the direction of the X axis of the coordinate system of the numerical controller 15. Guide shoes 20 of the stroke drive device 13 run on the guide rails 19. The mutual engagement of the guide rail 19 and the guide shoe 20 is such that this connection can also bear a load acting in the vertical direction. The stroke device 13 is mounted on the machine frame 2 via the guide shoes 20 and the guide rails 19. A further component of the stroke drive device 13 is a wedge gear 21, by which the position of the upper tool 11 relative to the lower tool 9 is adjustable.

The lower tool 9 is received moveably along a lower positioning axis 25. This lower positioning axis 25 runs in the direction of the Y axis of the coordinate system of the numerical controller 15. The lower positioning axis 25 can be oriented parallel to the upper positioning axis 16. The lower tool 9 can be moved directly on the lower positioning axis 16 by a motor drive assembly 26 along the positioning axis 25. Alternatively or additionally, the lower tool 9 can also be provided on a stroke drive device 27 that is moveable along the lower positioning axis 25 by the motor drive assembly 26. This drive assembly 26 can be configured as a spindle drive assembly. The structure of the lower stroke drive device 27 can correspond to that of the upper stroke drive device 13. The motor drive assembly 26 likewise can correspond to the motor drive assembly 17.

The lower stroke drive device 27 is mounted displaceably on guide rails 19 associated with a lower horizontal frame limb 4. Guide shoes 20 of the stroke drive device 27 run on the guide rails 19, such that the connection between the guide rails 19 and guide shoes 20 at the lower tool 9 can also bear a load acting in the vertical direction. Accordingly, the stroke drive device 27 is also mounted on the machine frame 2 via the guide shoes 20 and the guide rails 19, moreover at a distance from the guide rails 19 and guide shoes 20 of the upper stroke drive device 13. The stroke drive device 27 can also include a wedge gear 21, by which the position or height of the lower tool 9 along the Z axis (e.g., lower stroke axis 30, as shown in FIG. 1) is adjustable.

Via the numerical controller 15, both the motor drives 17 for a traversing movement of the upper tool 11 along the upper positioning axis 16 and the one or more motor drives 26 for a traversing movement of the lower tool 9 along the lower positioning axis 25 can be controlled independently of one another. The upper and lower tools 11, 9 are thus moveable synchronously in the direction of the Y axis of the coordinate system. An independent traversing movement of the upper and lower tools 11, 9 in different directions can also be controlled. This independent traversing movement of the upper and lower tools 11, 9 can be controlled simultaneously. As a result of the decoupling of the traversing movement between the upper tool 11 and the lower tool 9, an increased versatility of the machining of workpieces 10 can be attained. The upper and lower tools 11, 9 can also be configured to machine the workpieces 10 in many ways.

Figure 2:
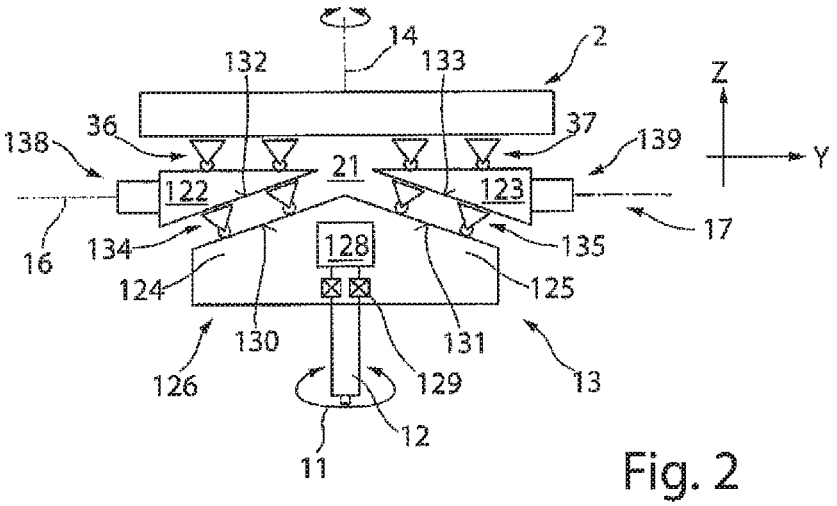
FIG. 2 shows a schematic depiction of the fundamental structure of a stroke drive device and a motor drive of FIG. 1.

One component of the stroke drive device 13 is the wedge gear 21 that is shown in FIG. 2. The wedge gear 21 includes two drive-side wedge gear elements 122, 123, and two output-side wedge gear elements 124, 125. The latter are combined structurally to form a unit in the form of an output-side double wedge 126. The ram 12 is mounted on the output-side double wedge 126 so as to be rotatable about the stroke axis 14. A motor rotary drive device 128 is accommodated in the output-side double wedge 126 and advances the ram 12 about the stroke axis 14 as necessary. Here, both a left-handed and a right-handed rotation of the ram 12 in accordance with the double-headed arrow in FIG. 2 are possible. A ram mounting 129 is shown schematically. The ram mounting 129 allows low-friction rotary movements of the ram 12 about the stroke axis 14, supports the ram 12 in the axial direction and dissipates loads that act on the ram 12 in the direction of the stroke axis 14 in the output-side double wedge 126.

The output-side double wedge 126 is defined by a wedge surface 130, and by a wedge surface 131 of the output-side gear element 125. Wedge surfaces 132, 133 of the drive-side wedge gear elements 122, 123 are arranged opposite the wedge surfaces 130, 131 of the output-side wedge gear elements 124, 125. By longitudinal guides 134, 135, the drive-side wedge gear element 122 and the output-side wedge gear element 124, and also the drive-side wedge gear element 123 and the output-side wedge gear element 125, are guided moveably relative to one another in the direction of the Y axis, that is to say in the direction of the positioning axis 16 of the stroke drive device 13.

The drive-side wedge gear element 122 has a motor drive unit 138, and the drive-side wedge gear element 123 has a motor drive unit 139. Both drive units 138, 139 together form the spindle drive assembly 17.

The drive spindle 18 shown in FIG. 1 is common to the motor drive units 138, 139, as is the stroke drive device 13, 27 that is mounted on the machine frame 2 and consequently on the supporting structure.

The drive-side wedge gear elements 122, 123 are operated by the motor drive units 138, 139 in such a way that the wedge gear elements move, for example, towards one another along the positioning axis 16, whereby a relative movement is performed between the drive-side wedge gear elements 122, 123 on the one hand and the output-side wedge gear elements 124, 125 on the other hand. As a result of this relative movement, the output-side double wedge 126 and the ram 12 mounted thereon is moved downwardly along the stroke axis 14. The punch mounted on the ram 12 for example as the upper tool 11 performs a working stroke and in so doing machines a workpiece 10 mounted on the workpiece rest 28, 29 or the workpiece support 8. By an opposite movement of the drive wedge elements 122, 123, the ram 12 is in turn raised or moved upwardly along the stroke axis 14.

The above-described stroke drive device 13 of FIG. 2 can be of the same design as the lower stroke drive device 27 and receives the lower tool 9.

Figure 3:
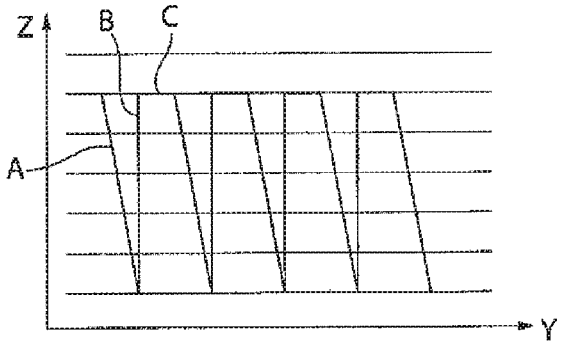
FIG. 3 shows a schematic graph of a superposed stroke movement in the Y and Z direction of the ram of FIG. 1.

FIG. 3 shows a schematic graph of a possible stroke movement of the ram 12. The graph shows a stroke profile along the Y axis and the Z axis. By a superposed control of a traversing movement of the ram 12 along the stroke axis 14 and along the positioning axis 16, an obliquely running stroke movement of the stroke ram 12 downwardly towards the workpiece 10 can, for example, be controlled, as shown by the first straight line A. Once the stroke has been performed, the ram 12 can then be lifted vertically, for example, as illustrated by the straight line B. An exclusive traversing movement along the Y axis is then performed in accordance with the straight line C, to position the ram 12 for a new working position relative to the workpiece 10. The previously described working sequence can then be repeated. If the workpiece 10 is moved on the workpiece rest surface 28, 29 for a subsequent machining step, a traversing movement along the straight line C can also be omitted.

The possible stroke movement of the ram 12 on the upper tool 11 shown in the graph in FIG. 3 can be combined with a lower tool 9 that is held stationary. Here, the lower tool 9 is positioned within the machine frame 2 in such a way that, at the end of a working stroke of the upper tool 11, the upper and lower tools 11, 9 each assume a defined position.

This exemplary superposed stroke profile can be controlled for both the upper tool 11 and the lower tool 9. Depending on the machining of the workpiece 10 that is to be performed, a superposed stroke movement of the upper tool and/or lower tool 11, 9 can be controlled.

Figure 4:
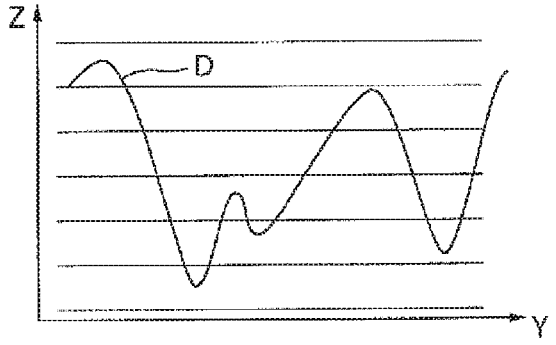
FIG. 4 shows a schematic graph of a further superposed stroke movement in the Y and Z direction of the ram of FIG. 1.

FIG. 4 shows a schematic graph illustrating a stroke movement of the ram 12 in accordance with the line D, shown by way of example, along a Y axis and a Z axis. In contrast to FIG. 3, in this exemplary embodiment a stroke movement of the ram 12 can pass through a curve profile or arc profile by controlling a superposition of the traversing movements in the Y direction and Z direction appropriately by the controller 15. By a versatile superposition of this kind of the traversing movements in the X direction and Z direction, specific machining tasks can be performed. The control of a curve profile of this kind can be provided for the upper tool 11 and/or the lower tool 9.

Figure 5:
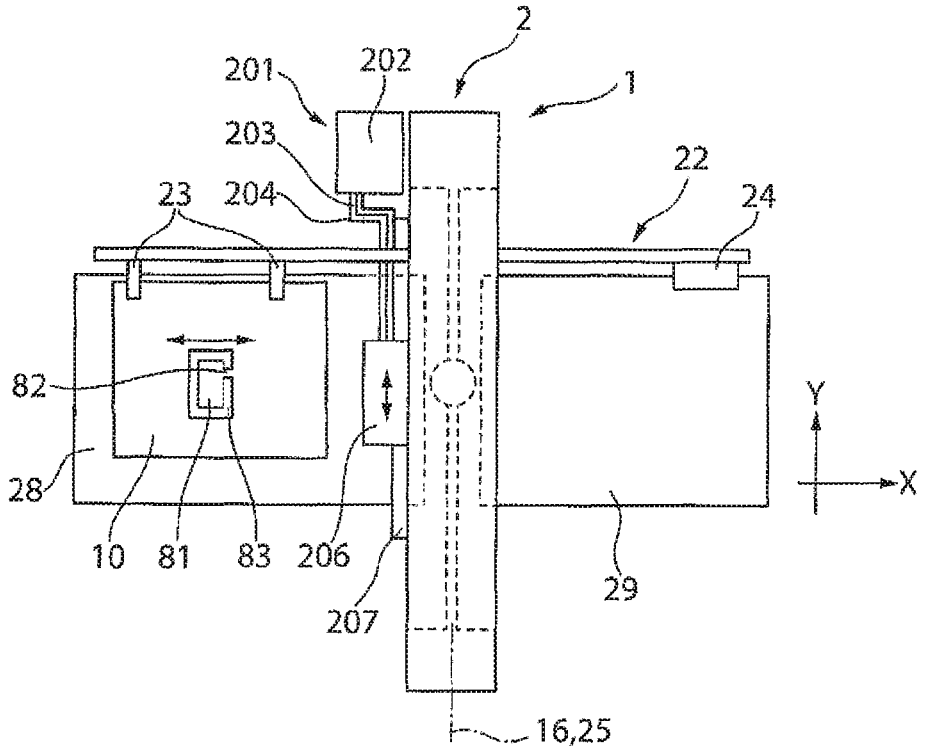
FIG. 5 shows a schematic view from above of the processing machine of FIG. 1 with workpiece rest surfaces.

FIG. 5 shows a schematic view of the processing machine 1 of FIG. 1. Workpiece rests 28, 29 extend laterally in one direction each on the machine frame 2 of the processing machine 1. The workpiece rest 28 can, for example, be associated with a loading station (not shown in greater detail), by which unprocessed workpieces 10 are placed on the workpiece rest 28. A feed device 22 is provided adjacent to the workpiece rest 28, 29 and includes a plurality of grippers 23 to grip the workpiece 10 placed on the workpiece rest 28. The workpiece 10 is guided through the machine frame 2 in the X direction by the feed device 22. The feed device 22 can also be controlled so as to be moveable in the Y direction. A free traversing movement of the workpiece 10 in the X-Y plane can thus be provided. Depending on the work task, the workpiece 10 can be moveable by the feed device 22 both in the X direction and against the X direction. This movement of the workpiece 10 can be adapted to a movement of the upper tool 11 and lower tool 9 in and against the Y direction for the machining work task at hand.

The further workpiece rest 29 is provided on the machine frame 2 opposite the workpiece rest 28. This further workpiece rest can be associated, for example, with an unloading station. Alternatively, the loading of the unprocessed workpiece 10 and unloading of the machined workpiece 10 having workpieces 81 can also be associated with the same workpiece rest 28, 29.

The processing machine 1 can furthermore include a laser machining device 201, such as the laser cutting machine that is shown schematically in in FIG. 5. This laser machining device 201 can be configured, for example, as a $CO_2$ laser cutting machine. The laser machining device 201 includes a laser source 202 that generates a laser beam 203 that is guided by a beam guide 204 (shown schematically) to a laser machining head, such as cutting head 206, and is focused therein. The laser beam 204 is then oriented perpendicularly to the surface of the workpiece 10 by a cutting nozzle to machine the workpiece 10. The laser beam 203 acts on the workpiece 10 at the machining location, e.g., the cutting location, jointly with a process gas beam. The cutting point, at which the laser beam 203 impinges on the workpiece 10, is adjacent to the machining point of the upper tool 11 and lower tool 9.

The laser cutting head 206 is moveable by a linear drive 207 having a linear axis system at least in the Y direction, or in the Y and Z direction. This linear axis system, which receives the laser cutting head 206, can be associated with the machine frame 2, fixed thereto or integrated therein. A beam passage opening can be provided in the workpiece rest 28 below a working space of the laser cutting head 206. A beam capture device for the laser beam 21 can be provided preferably beneath the beam passage opening 210. The beam passage opening and as applicable the beam capture device can also be configured as one unit.

The laser machining device 201 can alternatively also include a solid-state laser as laser source 202, the radiation of which is guided to the laser cutting head 206 with the aid of a fiber-optic cable.

The workpiece rest 28, 29 can extend to the workpiece support 8 that at least partially surrounds the lower tool 9. Within a resultant free space created therebetween, the lower tool 9 is moveable along the lower positioning axis 25 in and against the Y direction.

On the workpiece rest 28 there lies, for example, a machined workpiece 10, in which a workpiece part 81 has been cut free by a cutting gap 83, for example by punching or by laser beam machining, apart from a remaining connection 82. The workpiece 81 is held in the workpiece 10 or the remaining sheet skeleton by this remaining connection. To separate the workpiece part 81 from the workpiece 10, the workpiece 10 is positioned by the feed device 22 relative to the upper and lower tool 11, 9 for a separation and discharge step. Here, the remaining connection 82 is separated by a punching stroke of the upper tool 11 relative to the lower tool 9. The workpiece part 81 can, for example, be discharged downwardly by partially lowering the workpiece support 8. Alternatively, in the case of larger workpiece parts 81, the cut-free workpiece part 81 can be transferred back again onto the workpiece rest 28 or onto the workpiece rest 29 to unload the workpiece part 81 and the sheet skeleton. Small workpiece parts 81 can also be discharged optionally through an opening in the lower tool 9.

Figure 6:
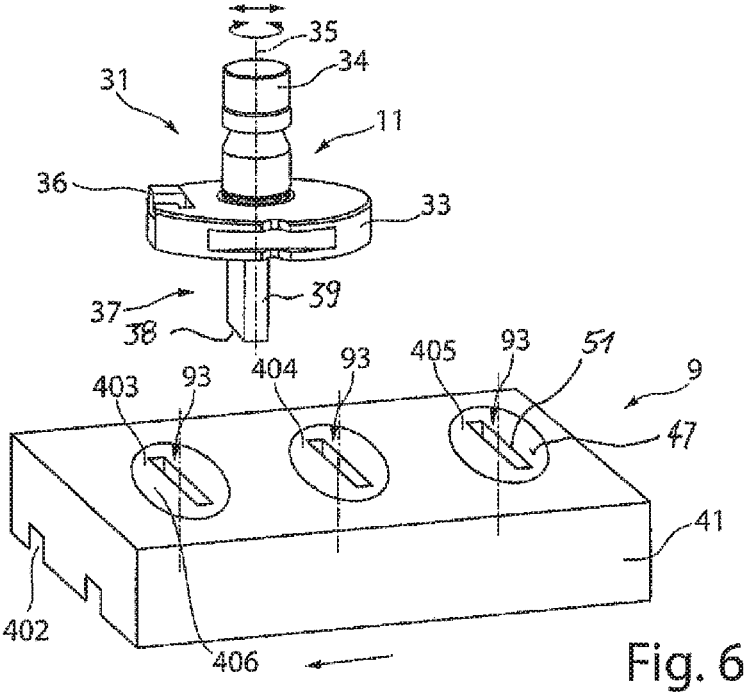
FIG. 6 shows a perspective view of a first embodiment of a tool.

FIG. 6 shows a perspective view of a first embodiment of a tool 31. The tool 31 is configured, for example, as a punching tool and includes an upper tool 11 that is also referred to as a punch. The tool 31 further includes a lower tool 9 that is also referred to as a die. The upper tool 11 has a main body 33 with a clamping shaft 34 and an adjustment or indexing wedge 36 arranged thereon. Opposite the clamping shaft 34 is a tool body 39 that has at least one cutting edge 38. The main body 33 and the clamping shaft 34 preferably lie along a positioning axis 35 that can also be a longitudinal axis of the upper tool 11. Via the adjustment or indexing wedge 36, the upper tool is oriented in an upper tool receptacle on the machine and is fixed thereto by the clamping shaft 34. By a possible rotary movement in the case of a tool body 39 that is not cylindrical and not arranged centrally relative to the positioning axis 35, an orientation of the tool body 39 relative to the lower tool 9 can take place.

The lower tool 9 likewise includes a main body 41 for arrangement of the lower tool 9 in the lower tool receptacle on the machine. In this exemplary embodiment of the lower tool 9, the lower tool has a guide 402 by which the main body 31 of the lower tool 9 is moveable along a lower tool receptacle. Alternatively, the main body 41 of the lower tool 9 can be fixedly arranged in the lower tool receptacle and a traversing movement along the arrow in the Y direction within the machine frame 2 controlled by the lower drive assembly 26 along the lower positioning axis 25.

The lower tool 9 has, for example, a group of counter tool bodies 93 that each have a counter cutting edge 51. The counter cutting edge 51 is configured as a closed contour, whereby an opening is formed inside the counter tool body 93. A cutting contour of the tool body 39 is adapted to the closed contour of the counter tool body 93. The counter tool bodies 93, of which three are depicted, arranged in the lower tool 9 have contours 403, 404 and 405 that differ from one another in size. The differences are such that, in relation to the cutting contour of the tool body 37, there is an adjustment of the cutting gap to different material thicknesses for the workpiece 10 to be machined. For example, in the case of a tool body 39 with a width of a cutting contour of 8 mm, the first contour 403 includes a width of 8.1 mm, the second contour 404 a width of 8.2 mm and the third contour 405 a width of 8.4 mm. As a result it is possible, for example, by combining the tool body 39 with the first contour 403 to cut a workpiece 10 (e.g., a metal sheet) with a material thickness of 1 mm, by combining the tool body 39 with the second contour 404 of the counter tool body 93 to cut a metal sheet with a material thickness of 2 mm, and by combining the tool body 39 with the third contour 405 to cut a metal sheet with a material thickness of 4 mm.

Such a tool 31 thus makes it possible that, for example, three different material thicknesses of a workpiece can be machined with only one cutting contour of the tool body 39 on the upper tool 11, without it being necessary to change the tool 31. The lower tool 9 can also include only two or also more than three counter tool bodies 93.

For positioning the upper tool 11 relative to the lower tool 9, the tool body 39 can be oriented relative to the counter cutting edge 93 by a rotary movement about the positioning axis 35. By a traversing movement of the upper tool 11 along the upper positioning axis 16 and/or of the lower tool 9 along the lower positioning axis 25, after the material thickness of the workpiece 10 to be machined has been established the tool body 39 of the upper tool 11, can be moved towards one of the three contours 403, 404 or 405 of the counter tool body 93 in the lower tool 9 and oriented so that the positioning axis 35 of the upper tool 11 and the positioning axis 48 of the lower tool 9 coincide. That is, the tool body 39 and the counter tool body 93 are oriented relative to one another.

The counter tool bodies 93 can be configured as a main body insert 406, so that it is replaceable relative to the main body 41 of the lower tool 9. In the case of wear, simple replacement is made possible. Moreover, the main body insert 406 can be rotatably controllable on the main body 41 of the lower tool 9. The cutting contour of the tool body 39 can in turn be adjusted and oriented relative to the closed contour of the counter cutting edge 51 in the counter tool body 93 by orientation of the upper tool 11.

Figure 7:
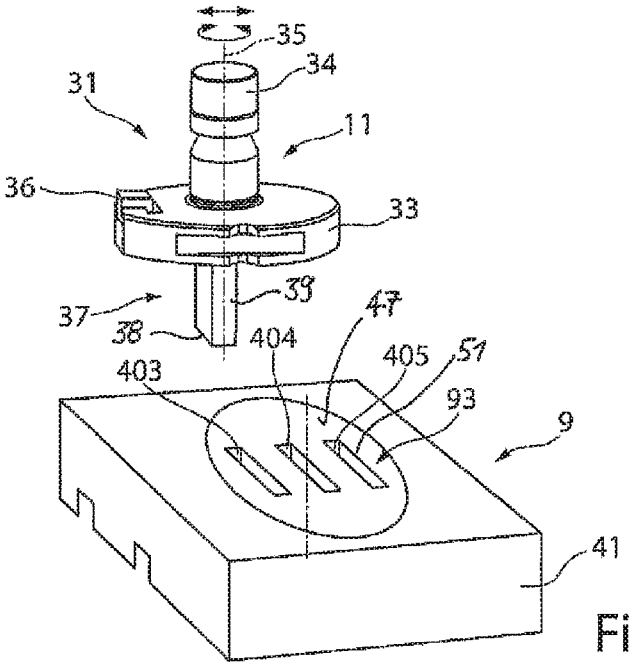
FIG. 7 shows a perspective view of an alternative embodiment of the tool as compared to FIG. 6.

FIG. 7 shows a perspective view of an alternative embodiment than that of FIG. 6. The upper tool 11 of FIG. 7 corresponds to the upper tool 11 of FIG. 6. The lower tool 9 of FIG. 7 differs from that shown in FIG. 6 in that the counter tool bodies 93, of which there are for example three, are on a main body insert 406. This main body insert 406 can also be replaceable. With regard to the configuration and arrangement of the closed contours 403, 404 and 405 of the counter cutting edges 51, reference can be made to the embodiments of FIG. 6 in their entirety—likewise in respect of the positioning of the upper tool 11 relative to the lower tool 9.

Figure 8:
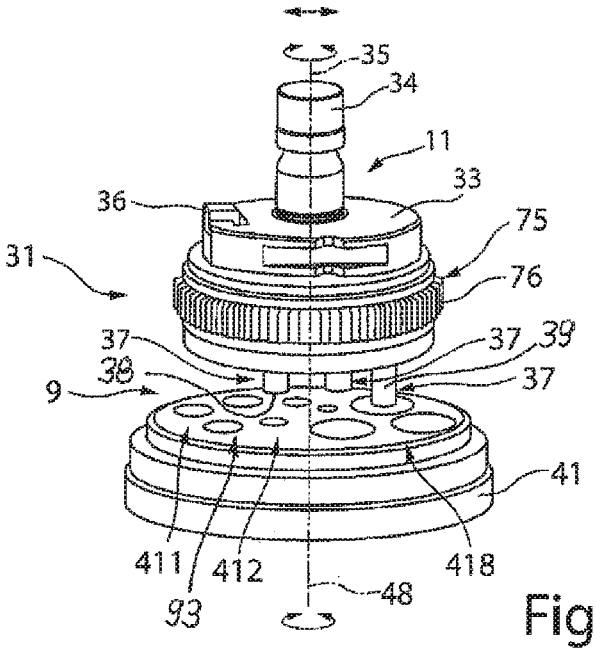
FIG. 8 shows a perspective view of a further alternative embodiment of the tool as compared to FIG. 6.

FIG. 8 shows, in perspective, an alternative embodiment of the tool 31. In this embodiment, the upper tool 11 is in the form of a multi tool. On the main body 33 are a plurality of tool bodies 39 each having a cutting edge 38. These tool bodies 39 are configured as inserts that are insertable into the main body 33. For controlling individual machining tools 37 is an activating device 75 that is rotatable radially relative to the positioning axis. The activating device 75 has teeth 76 on the outer circumference. The activating device 75 can be driven in rotation by a drive on the machine on the upper tool receptacle. By the rotation, an activating element (not shown) extending into the main body 33 is positioned in a position relative to the chosen tool body 39 such that that tool body is fixedly arranged relative to the main body 33. The further tool bodies 39 are able to be inserted into the main body 33 when the upper tool 11 performs a stroke movement towards the workpiece 10.

The upper tool 11 corresponds to the embodiment in FIG. 6. For example, three machining tools 37 are in the upper tool 11 shown in FIG. 8 that have tool bodies 39 that differ from one another in shape and/or size.

The lower tool 9 includes a main body 41 and a rest surface 47 on which the workpiece 10 rests during machining. A plurality of counter tool bodies 93 are on the rest surface 47 of the main body 41 of the lower tool 9.

Figure 9:
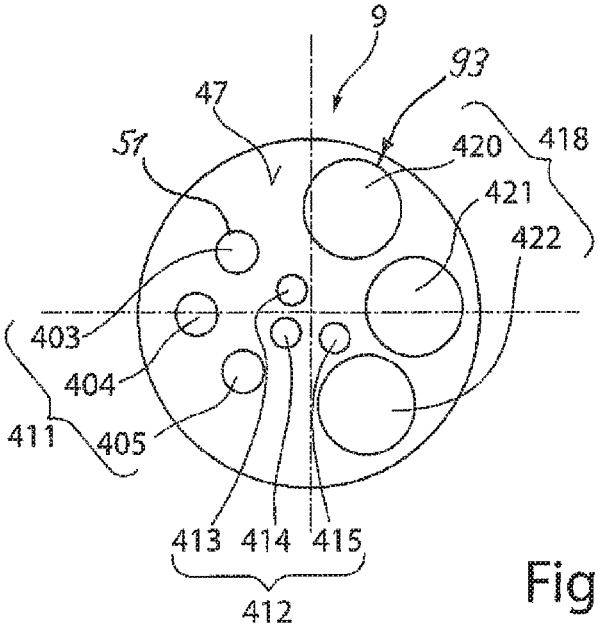
FIG. 9 shows a schematic view of the lower tool of the tool in FIG. 8.

FIG. 9 shows a view from above of the lower tool 9 of FIG. 8. The counter tool bodies 93 have a closed contour; in cooperation with the tool body 39 on the upper tool 11, a cut of a size and contour defined by the cutting edge 38 and the counter cutting edge 51 is formed in the workpiece 10. For example, circular, square, rectangular or elongate cutouts or the like can be made. The size and/or geometry is arbitrary.

Associated with one of the tool bodies 39 of the upper tool 11 is a first group 411 of counter tool bodies 93 that have closed contours 403, 404, 405 that differ in size from each other. The difference in size of the contours 403, 404 and 405 within a group 411 adjusts the cutting gap to the material thickness of the workpiece 10 to be machined. The number of different contours is only by way of example. The group can have two or more than three mutually different contours. These closed contours 403, 404, 405 differ from the cutting contour of the first tool body 39 to the effect that there is an adjustment of the cutting gap in relation to different material thicknesses of the workpieces 10 to be machined.

In the lower tool 9 there is, for example, in addition to the first group 411, a second group 412 of counter tool bodies 93 that cooperate with a second tool body 39 on the upper tool 11. This second group 412 of counter tool bodies 93 is, for example, smaller in diameter than the first group 411 of counter tool bodies 93. For example, three contours 413, 414, 415, which differ in size from one another, of the counter tool bodies 93 can form that group for cutting gap adjustment for the same tool body 39. The number of counter tool bodies 93 per group 411, 412 can also differ from one another.

If sufficient free surface is available in the rest surface 47 to form further counter tool bodies 93, a third group 418 of counter tool bodies 93 as well as a plurality of further groups can be provided. Only by way of example, the third group 418 of counter tool bodies 93 again has three mutually different contours 420, 421 and 422 of the counter tool bodies 93. There can also be only two or more than three counter tool bodies 93. This third group 418 of counter tool bodies 93 is associated with the third tool body 39 on the upper tool 11.

Advantageously, the number of contours in at least two groups 411, 412 of counter tool bodies 3 arranged in the lower tool 9 can be equal, so that the same number of different material thicknesses can be machined with that tool 31.

Alternatively, it is also possible that the first group 411 and the at least one further group 412, 418 have numbers of contours on the counter tool body 93 that differ from one another.

The shape and/or geometry of the closed contour of the counter tool bodies 93 of the first group 411 can also differ from that of the second group 412 and/or of the further group 418.

The arrangement of the counter tool bodies 93 in the rest surface 47 of the lower tool 9 can be outside a common circle. The first and at least one further group 411, 412, 418 can also be arranged outside a common circle of the rest surface 47. By controlling a traversing movement of the upper tool 11 and of the lower tool 9 independently of each other, and also by controlling the rotary movement of the upper tool 11 and of the lower tool 9 again independently of each other, it is possible to orient one tool body 37 on the upper tool 11 appropriately for the respective closed contour of the first group 414 or of the further group 412, 418. An arrangement of the counter tool bodies 93 on a circle concentric to the positioning axis 48 and the arrangement of the tool body 39 concentric to the positioning axis 35 is therefore not necessary.

Figure 10:
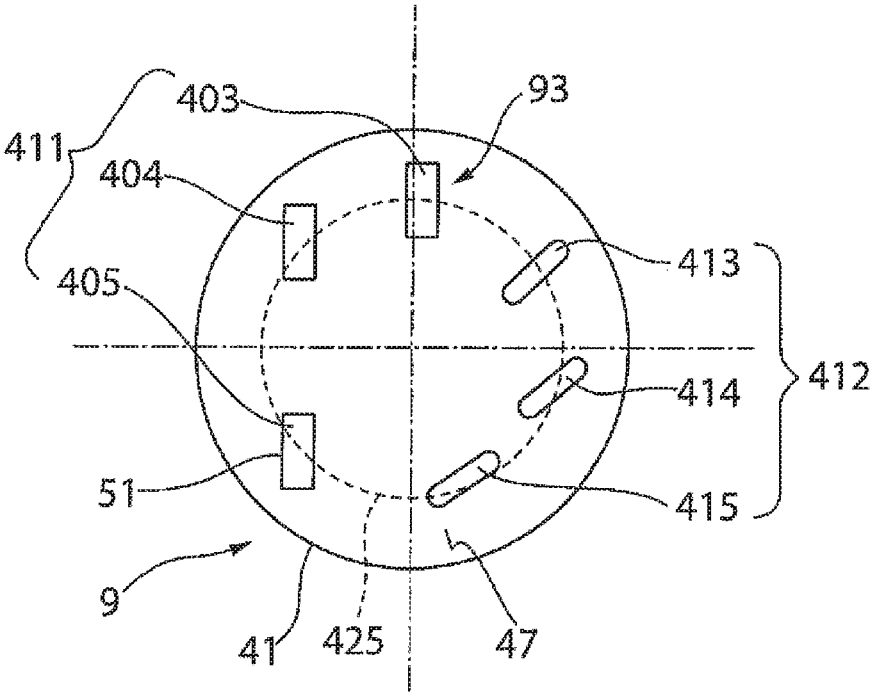
FIG. 10 shows a schematic view of an alternative embodiment of the lower tool as compared to FIG. 9.

FIG. 10 shows a schematic view of an alternative embodiment of the lower tool 9 than that of FIG. 9. In this embodiment of the lower tool 9, only two groups 411 and 412 of counter tool bodies 93 are shown. The first group 411 has counter tool bodies 93 that have, for example, a rectangular closed contour 403, 404, 405. In the second group 412, the counter tool bodies 93 have, for example, an elongate contour 413, 414, 415. The first group 411 of counter tool bodies 93 lies on a common circle 425. The counter tool bodies 93 are so oriented relative to each other that they lie outside an angular position that the contour of the counter tool body 93 assumes if it is also rotated along the circle 425. In the exemplary embodiment shown, the counter tool bodies 93 are, for example, oriented in the same direction. The counter tool bodies 93 can also all be arranged at mutually different angles on a circle 425, where the angular positions of these counter tool bodies 93 are again different from the position that is assumed by the contour on rotation along a circle 425. In the case of the arrangement of the counter tool bodies 93 on the circle 425 of the rest surface 47 of the lower tool 9, contours that have a contour profile that differs from a circular geometry are provided.

The first group 411 of counter tool bodies 93 can lie on a circle 425. The at least one further group 412, 418 of counter tool bodies 93 can lie on further circles different from the circle 425 or can also be arranged outside that circle.

OTHER EMBODIMENTS

A number of embodiments of the invention have been described. Nevertheless, it will be understood that various modifications may be made without departing from the spirit and scope of the invention. Accordingly, other embodiments are within the scope of the following claims.

What is claimed is:

1. A tool for machining planar workpieces, comprising:

an upper tool having a clamping shaft and an upper main body that lie on a common upper positioning axis;

at least one tool body arranged on the upper main body opposite the clamping shaft, wherein the tool body has a cutting edge;

a lower tool having a lower main body with a rest surface for the workpiece and a lower positioning axis oriented perpendicular to the rest surface; and at least one group of at least two counter tool bodies arranged on the lower main body and each comprising respective counter cutting edges, wherein the at least two counter tool bodies of the at least one group lie outside of an imaginary circle in the rest surface of the lower tool, wherein the circle is concentric to the lower positioning axis at a distance from the lower positioning axis that is smaller than a distance from the lower positioning axis to the at least two counter tool bodies of the at least one group, wherein the cutting edge of the at least one tool body has a cutting contour that corresponds to counter cutting contours of the counter cutting edges of the group of at least two counter tool bodies, wherein the at least one group of at least two counter tool bodies on the lower tool can be associated with the cutting contour of the at least one tool body via a traversing movement perpendicular or inclined to the upper positioning axis of the upper tool or the lower positioning axis of the lower tool, or both, or by a combination of the traversing movement perpendicular or inclined to the upper or lower positioning axis and by a rotary movement about the upper positioning axis of the upper tool or the lower positioning axis of the lower tool, or both, and wherein, in the at least one group, the counter cutting contour of a first counter tool body corresponds to the cutting contour of the at least one tool body with a first cutting gap width and the counter cutting contour of a second or further counter tool body corresponds to the cutting contour of the at least one tool body with a second or further cutting gap width.

2. The tool of claim 1, wherein the at least one group of counter tool bodies is insertable in the lower main body each individually on a main body insert or together on a main body insert.

3. The tool of claim 2, wherein the main body insert is rotatable with respect to the main body of the lower tool.

4. The tool of claim 1, wherein the upper tool comprises a multi-tool and has at least two tool bodies each having a cutting edge and a cutting contour, and wherein the lower tool has at least two groups of counter tool bodies.

5. A tool for machining planar workpieces, comprising:

an upper tool having a clamping shaft and an upper main body that lie on a common upper positioning axis;

at least one tool body arranged on the upper main body opposite the clamping shaft, wherein the tool body has a cutting edge;

a lower tool having a lower main body with a rest surface for the workpiece and a lower positioning axis oriented perpendicular to the rest surface; and at least one group of at least two counter tool bodies arranged on the lower main body and each comprising respective counter cutting edges, wherein the cutting edge of the at least one tool body has a cutting contour that corresponds to counter cutting contours of the counter cutting edges of the group of at least two counter tool bodies, wherein the at least one group of at least two counter tool bodies on the lower tool can be associated with the cutting contour of the at least one tool body via a traversing movement perpendicular or inclined to the upper positioning axis of the upper tool or the lower positioning axis of the lower tool, or both, or by a combination of the traversing movement perpendicular or inclined to the upper or lower positioning axis and by a rotary movement about the upper positioning axis of the upper tool or the lower positioning axis of the lower tool, or both, wherein, in the at least one group, the counter cutting contour of a first counter tool body corresponds to the cutting contour of the at least one tool body with a first cutting gap width and the counter cutting contour of a second or further counter tool body corresponds to the cutting contour of the at least one tool body with a second or further cutting gap width, and wherein the first and at least one further group of counter tool bodies do not lie on an imaginary circle in the rest surface of the lower tool, wherein the circle is concentric to the lower positioning axis at a distance from the lower positioning axis that is smaller or larger than a distance from the lower positioning axis to the first and the at least one further group of counter tool bodies.

6. A processing machine for machining planar workpieces, comprising:

an upper tool having a clamping shaft and an upper main body and that is moveable along an upper stroke axis by a stroke drive device in a direction towards or away from a workpiece to be processed by the upper tool, and that is positionable along an upper horizontal positioning axis running perpendicular to the upper stroke axis;

an upper drive assembly configured to displace the upper tool along the upper positioning axis;

a lower tool having a lower main body with a rest surface for the workpiece and that is moveable along a lower stroke axis by a stroke drive device in the direction of the upper tool, and that is positionable along a lower horizontal positioning axis oriented perpendicular to the upper stroke axis of the upper tool and oriented perpendicular to the rest surface;

a lower drive assembly configured to displace the lower tool along the lower positioning axis;

a controller configured to control the upper and lower drive assemblies and to control a traversing movement of the upper tool along the upper horizontal positioning axis and a traversing movement of the lower tool along the lower horizontal positioning axis independently of each other;

at least one tool body arranged on the upper main body opposite the clamping shaft, wherein the tool body has a cutting edge; and at least one group of at least two counter tool bodies arranged on the lower main body and each comprising respective counter cutting edges, wherein the at least two counter tool bodies of the at least one group lie outside of an imaginary circle in the rest surface of the lower tool, wherein the circle is concentric to the lower positioning axis at a distance from the lower positioning axis that is smaller than a distance from the lower positioning axis to the at least two counter tool bodies of the at least one group, wherein the cutting edge of the at least one tool body has a cutting contour that corresponds to counter cutting contours of the counter cutting edges of the group of at least two counter tool bodies, wherein the at least one group of at least two counter tool bodies on the lower tool can be associated with the cutting contour of the at least one tool body via a traversing movement perpendicular or inclined to a vertical positioning axis of the upper tool or lower tool or both, or by a combination of the traversing movement perpendicular or inclined to the vertical positioning axis and by a rotary movement about the upper vertical positioning axis of the upper tool or lower vertical positioning axis of the lower tool, or both, and in the at least one group, the counter cutting contour of a first counter tool body corresponds to the cutting contour of the at least one tool body with a first cutting gap width and the counter cutting contour of a second or further counter tool body corresponds to the cutting contour of the at least one tool body with a second or further cutting gap width.

7. The machine tool of claim 6, wherein at least one of the upper tool and lower tool is positionable relative to the other by a traversing movement along the respective upper horizontal positioning axis or lower horizontal positioning axis, or both;

by a traversing movement along the upper vertical positioning axis or the lower vertical positioning axis, or both; or by a rotary movement about the upper vertical positioning axis or the lower vertical positioning axis, or both.

8. A method for machining planar workpieces, the method comprising:

obtaining a tool that comprises:

an upper tool having a clamping shaft and an upper main body that lie on a common upper vertical positioning axis;

at least one tool body arranged on the upper main body opposite the clamping shaft, wherein the tool body has a cutting edge;

a lower tool having a lower main body with a rest surface for the workpiece and a lower vertical positioning axis oriented perpendicular to the rest surface; and at least one group of at least two counter tool bodies arranged on the lower main body and each comprising respective counter cutting edges, wherein the at least two counter tool bodies of the at least one group lie outside of an imaginary circle in the rest surface of the lower tool, wherein the circle is concentric to the lower positioning axis at a distance from the lower positioning axis that is smaller than a distance from the lower positioning axis to the at least two counter tool bodies of the at least one group, wherein the cutting edge of the at least one tool body has a cutting contour that corresponds to counter cutting contours of the counter cutting edges of the group of at least two counter tool bodies, wherein the at least one group of at least two counter tool bodies on the lower tool can be associated with the cutting contour of the at least one tool body via a traversing movement perpendicular or inclined to the upper vertical positioning axis of the upper tool or the lower vertical positioning axis of the lower tool, or both, or by a combination of the traversing movement perpendicular or inclined to the upper or lower vertical positioning axis and by a rotary movement about the upper vertical positioning axis of the upper tool or the lower vertical positioning axis of the lower tool, or both, and in the at least one group, the counter cutting contour of a first counter tool body corresponds to the cutting contour of the at least one tool body with a first cutting gap width and the counter cutting contour of a second or further counter tool body corresponds to the cutting contour of the at least one tool body with a second or further cutting gap width;

moving the upper tool along a stroke axis by a stroke drive device in a direction towards or away from a workpiece to be processed by the upper tool, wherein the upper tool is positionable along an upper horizontal positioning axis running perpendicular to the stroke axis, and is displaceable by an upper drive assembly along the upper horizontal positioning axis;

moving the lower tool along a lower stroke axis by a stroke drive device in the direction of the upper tool, wherein the lower tool is positionable along a lower horizontal positioning axis oriented perpendicular to the stroke axis of the upper tool, and is displaceable by a lower drive assembly along the lower horizontal positioning axis;

providing a controller to actuate the upper and lower drive assemblies to move the upper and lower tools; and using a tool to process the workpieces.

9. The method of claim 8, wherein the tool body of the upper tool and the counter tool body of the lower tool are oriented relative to one another at least by a traversing movement along the upper or lower horizontal positioning axis or both or by a rotary movement of the upper tool or of the lower tool both about their respective vertical positioning axes.

10. The method of claim 8, wherein, in an upper tool configured as a multi tool, one of the tool bodies on the upper tool is chosen for the subsequent machining operation by actuation of an activating device.

* * * * *